US008039029B2

(12) United States Patent
Ozanne

(10) Patent No.: US 8,039,029 B2
(45) Date of Patent: Oct. 18, 2011

(54) CAPSULE FOR THE PREPARATION OF A BEVERAGE

(75) Inventor: Matthieu Ozanne, Chessel (CH)

(73) Assignee: Nestec S.A., Vevey (CH)

( * ) Notice: Subject to any disclaimer, the term of this patent is extended or adjusted under 35 U.S.C. 154(b) by 414 days.

(21) Appl. No.: 12/438,476

(22) PCT Filed: Aug. 23, 2007

(86) PCT No.: PCT/EP2007/058756

§ 371 (c)(1),
(2), (4) Date: Mar. 24, 2009

(87) PCT Pub. No.: WO2008/025715

PCT Pub. Date: Mar. 6, 2008

(65) Prior Publication Data

US 2009/0263545 A1 Oct. 22, 2009

(30) Foreign Application Priority Data

Aug. 30, 2006 (EP) ..... 06119800

(51) Int. Cl.
*B65B 29/02* (2006.01)

(52) U.S. Cl. ..... 426/77; 426/78; 426/79; 99/295

(58) Field of Classification Search ..... 426/77, 426/78, 79; 99/295, 279
See application file for complete search history.

(56) References Cited

U.S. PATENT DOCUMENTS

2006/0219098 A1* 10/2006 Mandralis et al. ..... 99/279

FOREIGN PATENT DOCUMENTS

| | | |
|---|---|---|
| DE | 2645885 B1 | 7/1977 |
| EP | 1500358 | 1/2005 |
| EP | 1894850 | 3/2008 |
| WO | WO 2006021405 | 2/2006 |

OTHER PUBLICATIONS

International Search Report for International Application No. PCT/EP2007/058756 mailed on Jan. 25, 2008.
Written Opinion for International Application No. PCT/EP2007/058756 mailed on Jan. 25, 2008.

* cited by examiner

*Primary Examiner* — Rena Dye
*Assistant Examiner* — Chaim Smith
(74) *Attorney, Agent, or Firm* — K&L Gates LLP

(57) ABSTRACT

The capsule (2) for brewing food fragments comprises a filtering means (22) delimitating one filtering side of a brewing enclosure (20). It also comprises an overflow wall (3) positioned in the path of brewed liquid after the filtering means. The filtering means (22) are integral with the overflow wall (3).

18 Claims, 3 Drawing Sheets

CAPSULE FOR THE PREPARATION OF A BEVERAGE

BACKGROUND OF THE INVENTION

The present invention relates to a capsule for preparing and delivering a beverage in a brewing device. The present invention more particularly aims at providing a capsule adapted to deliver brewed leaf tea although other beverages can be successfully brewed in the capsule.

Leaf tea ingredients are generally obtained from loose leaves that are chiselled or broken into small fragments. Brewing of these fragments can lead to the presence of large quantities of insoluble particles mixed with the infused solution. Therefore, when a capsule is designed specifically for delivering tea, it is important that it comprise filtering means. These filtering means should be adapted to let the liquid beverage freely out of the capsule, while simultaneously keeping all but a negligible amount of the undesirable ingredient particles inside the brewing enclosure.

European Patent application No. 05109566.9 describes several embodiments of a capsule adapted for brewing tea in a beverage machine. The capsule comprises a filtering wall delimiting one filtering side of the brewing enclosure. An overflow wall comprising at least one overflow aperture is positioned in the path of the brewed liquid after the filtering. In one particular embodiment, the filtering wall extends substantially from the bottom to the top of the enclosure. This arrangement provides a large filtering surface and thus favours a lower brewing pressure. Another feature of this particular embodiment is that the overflow wall is parallel to the filtering wall, and that an interstitial space separates the two walls. This configuration allows for the liquid that has gone through the filter to move upwards in the interstitial space until it reaches the overflow aperture. This aperture is sufficiently close to the top of the brewing enclosure. In this way, the beverage ingredients can be entirely submerged by the low pressure brewing fluid, while the flow rate from the capsule remains within the acceptable range.

The capsule described in European patent application No. 05109566.9 is based on a brewing principle that promotes the delivery of high quality tea. However, as previously described, the capsule comprises both a filtering wall and an overflow wall with an interstitial space between the two. It may further comprise a cover that faces the overflow wall. These features lead to a relatively complex structure that can be expensive to produce. Therefore, it would be desirable to provide a capsule based on the same or similar brewing principle but with a simplified, easier to manufacture and cheaper structure.

BRIEF SUMMARY OF THE INVENTION

In the present application, the terms "capsule" or "cartridge" or "package" are considered as synonymous. The term "capsule" will preferentially be used. The words "brewing" or "infusion" are used as synonymous. The term "brewing fluid" generally refers to the liquid that serves to infuse the beverage ingredients, more generally, hot water.

In the present application, the term "tea" encompasses all type of leaf tea such as green tea, black tea, white tea, chai tea, flavoured tea and herbal or fruit tea. The term "leaf tea" or "leaf ingredient" refers to brewable tea or other ingredients in whatever form such as complete, cut or chiselled leaves forming fragments of leaves.

The present invention provides a capsule that is adapted to brew or infuse beverages in a beverage machine that may provide the following advantages:

- the capsule is less complicated and less expensive to produce,
- the quality of the beverage can be improved, in particular, in relation to the beverage concentration into the cup, the taste and the reduced turbidity,
- the beverage delivery is cleaner and it reduces or eliminates the taste cross-contamination and hygiene issues,
- the convenience of the capsule handling, i.e., insertion and collection of the used capsules can be improved.

For these purposes as well as many others possible, the invention relates to a capsule for brewing food fragments in a beverage machine comprising:

an enclosure containing fragments;

filtering means delimiting at least one filtering side of the enclosure, wherein an overflow wall is positioned in the path of the brewed liquid after the filtering means and comprises at least one overflow aperture; wherein said filtering means is integral with the overflow wall.

Furthermore, the filtering means are preferably configured to provide filtration both for beverage flowing in the direction of the overflow wall and for beverage flowing along the overflow wall and towards the overflow aperture.

Having the filtering means that are integral with the overflow wall allows to produce them in one single piece such as in a injected plastic, for instance, that can obtained by a process of injection moulding. This feature of the invention can therefore drastically reduce the cost of making the capsule.

Furthermore, the filtering means preferably extends from below a median horizontal plane passing through the enclosure when the capsule is oriented so that at least one overflow aperture is placed above said plane.

Therefore, according to one aspect of the invention, but without willing to be bound to any theoretical model, the filtering means are designed to behave a little like a "siphon" to enable the denser liquid to flow upwards along the overflow wall in order to pass through the overflow aperture and to become dispensed, while at the same time, the beverage ingredients can be submerged by the brewing fluid therefore avoiding bypassing areas in the enclosure and ensuring that the mass of ingredients fully interacts with the brewing fluid.

As a result, the capsule of the invention proposes a design that combines both the advantages of the gravimetric top-down directional brewing where the denser liquid can be captured and the advantages of the upward directional brewing where the full mass of product can be fully and slowly submerged but does not retain the disadvantages of each of said brewing principles.

In one mode, the filtering means comprise a plurality of studs protruding from the side of the overflow wall facing the enclosure. The studs can be arranged in rows on the wall so as to form a regular pattern. The distance between neighbouring studs is less than the average size of the food fragments brewed in the capsule. This arrangement insures that the studs will form an obstacle for most of the insoluble tea fragments contained in the brewed liquid flowing into, or through, the arrangement of studs. The studs thus can provide filtration both for beverage flowing in the direction of the overflow wall and for beverage flowing along the overflow wall towards the overflow aperture.

The arrangement of studs can extend substantially from the bottom of the enclosure to the top of the enclosure, while leaving substantially no large gap between the studs that might allow solid food ingredient to enter. These arrays thus create a sufficiently large filtering surface for the brewed liquid, which favours a lower brewing pressure in the enclosure and a slow flow, while the flow rate can stay within the acceptable range. The surface of the overflow wall on which the studs are distributed can be at least 500 $mm^2$, preferably of from 600 to 1500 $mm^2$. Trials at about 700 $mm^2$ provided good results with a delivered tea beverage having low turbidity.

The studs can form a regular lattice featuring a plurality of rows extending along two perpendicular directions, e.g., horizontally and vertically. The distribution of the studs can be such that the studs are spaced further apart along one direction than along another. This feature can be used to promote the flow of beverage towards the overflow aperture. In another possible embodiment, the studs are spaced apart the same distance in both perpendicular directions.

In one aspect, the at least one overflow aperture is situated above the ¾ of the height of the enclosure; even preferably, the aperture is substantially horizontally aligned with the top end of the enclosure. As a result the whole mass of the beverage ingredients can be properly submerged and consequently properly brewed regardless of the filling level of the enclosure by the beverage ingredients.

In another aspect, the studs can have substantially the same length.

According to the invention, the studs are integral with the overflow wall. The overflow wall and the studs can be made from a variety of materials including, but not limited to PET or PP.

According to the invention, the capsule is closed in a gas-tight manner. The capsule can further comprise perforation means comprising at least one perforating element configured to perforate a wall of the gas-tight container in order to create the beverage outlet from the said perforated wall of the capsule.

The capsule may further comprise flow guiding means configured to guide the beverage from the at least one overflow aperture to the beverage outlet of the capsule.

The beverage flow guiding means and the perforating element are integrally enclosed within the gas-tight capsule until it is used. The flow guiding means and perforating element can be protected by a perforable protective cover. One advantage of having the perforating element and the flow guiding means as a part of the capsule itself is that they are physically separated from the external environment. This feature prevents pollution of the flow guiding means during storage before use. Another advantage of having the perforating element and the flow guiding means as a part of the capsule is that practically no physical interaction is produced between the beverage and the machine parts, which avoids cross-contamination issues and results in less cleaning.

The perforating element is preferably configured to create the beverage outlet in the protective cover. The beverage flow guiding means, which have the function of conducting the brewed liquid smoothly to the beverage outlet from the capsule, can also be positioned adjacent to the protective cover.

Furthermore, the beverage outlet is preferably placed at a region of the cover that is substantially opposite to the overflow aperture(s), thus promoting a more "direct flow" approach with less chance of the brewed liquid to contaminate parts of the brewing device while ensuring, at the same time, that the liquid overflow is properly carried out in the capsule during brewing so that the ingredients are properly infused and product concentration in the cup is properly controlled.

The capsule can be conceived with a certain asymmetry in order to facilitate a proper insertion in the brewing device by the user. For this, the capsule can have an elongated shape with an axial distance and a shorter transversal distance and the at least one puncture means or puncture indicating means can be aligned along the axial distance. As a result, the user is forced to insert the capsule in a predetermined orientation that is desirable for a correct operation of the capsule as aforementioned. In a mode, the capsule can be ovoid.

As used herein, "food fragments" refer broadly to food, nutritional and/or medicinal solid material which is intended to be brewed or extracted with a brewing liquid but is not entirely dissolvable, extractable or dispersible in the brewing liquid so that solid material is left in the capsule after brewing. The fragments have a size which usually exceeds the size of powder. The fragments may typically have individual a size of between about 0.5 mm and 20 mm. The fragments may be cut, crushed or chiselled. The fragments may be fragments taken from plant leaves, flowers, stalks, roots, seeds or grains. Also fragments may also be entire leaves. The fragments may be formed from tea or other plants.

BRIEF DESCRIPTION OF THE DRAWINGS

Embodiments of the present invention will now be described, by way of example only, with reference to the accompanying drawings, in which.

Figure 1:
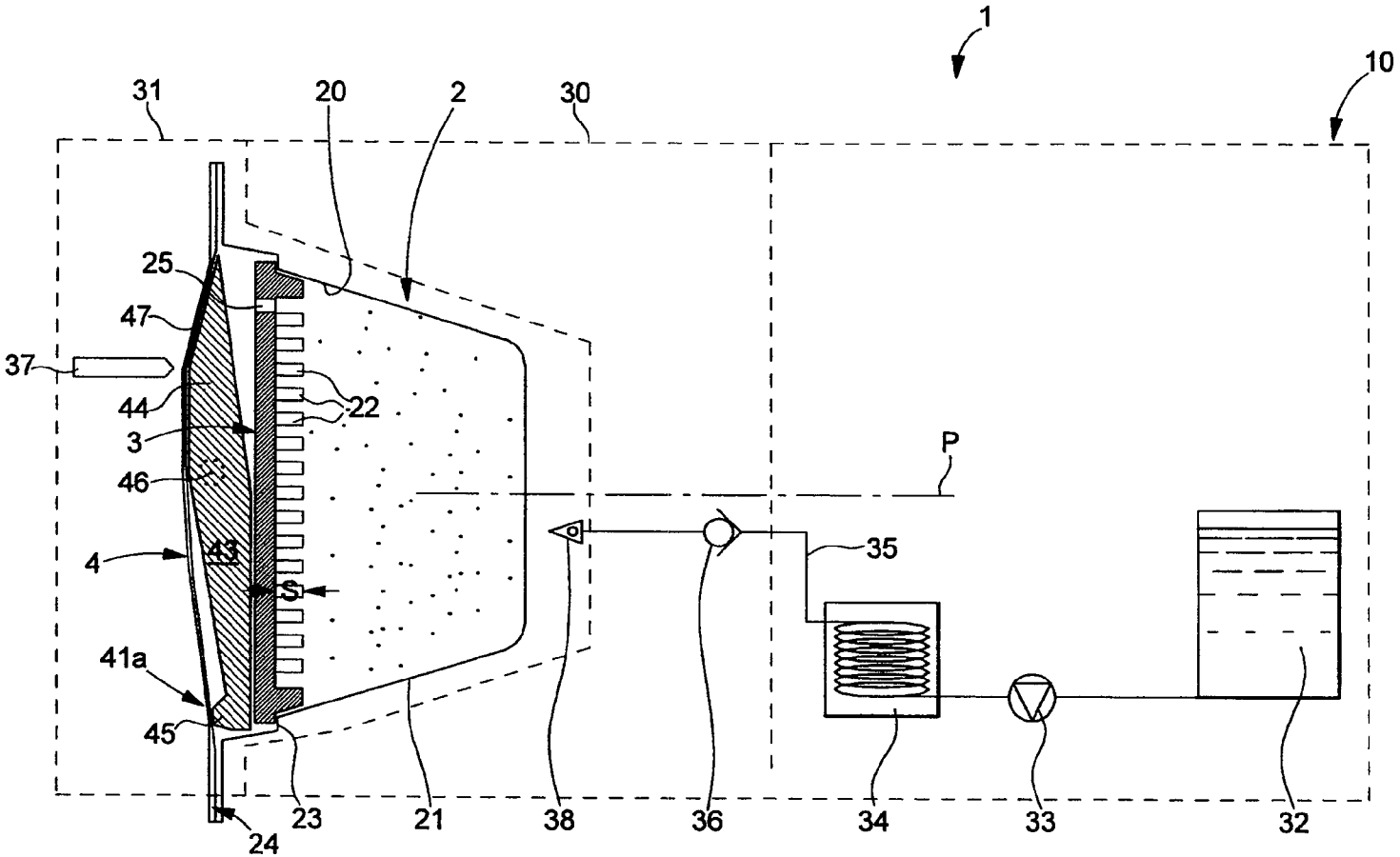
FIG. 1 is a schematic illustration of a capsule brewing system before brewing according to a particular embodiment of the invention.
Figure 2:
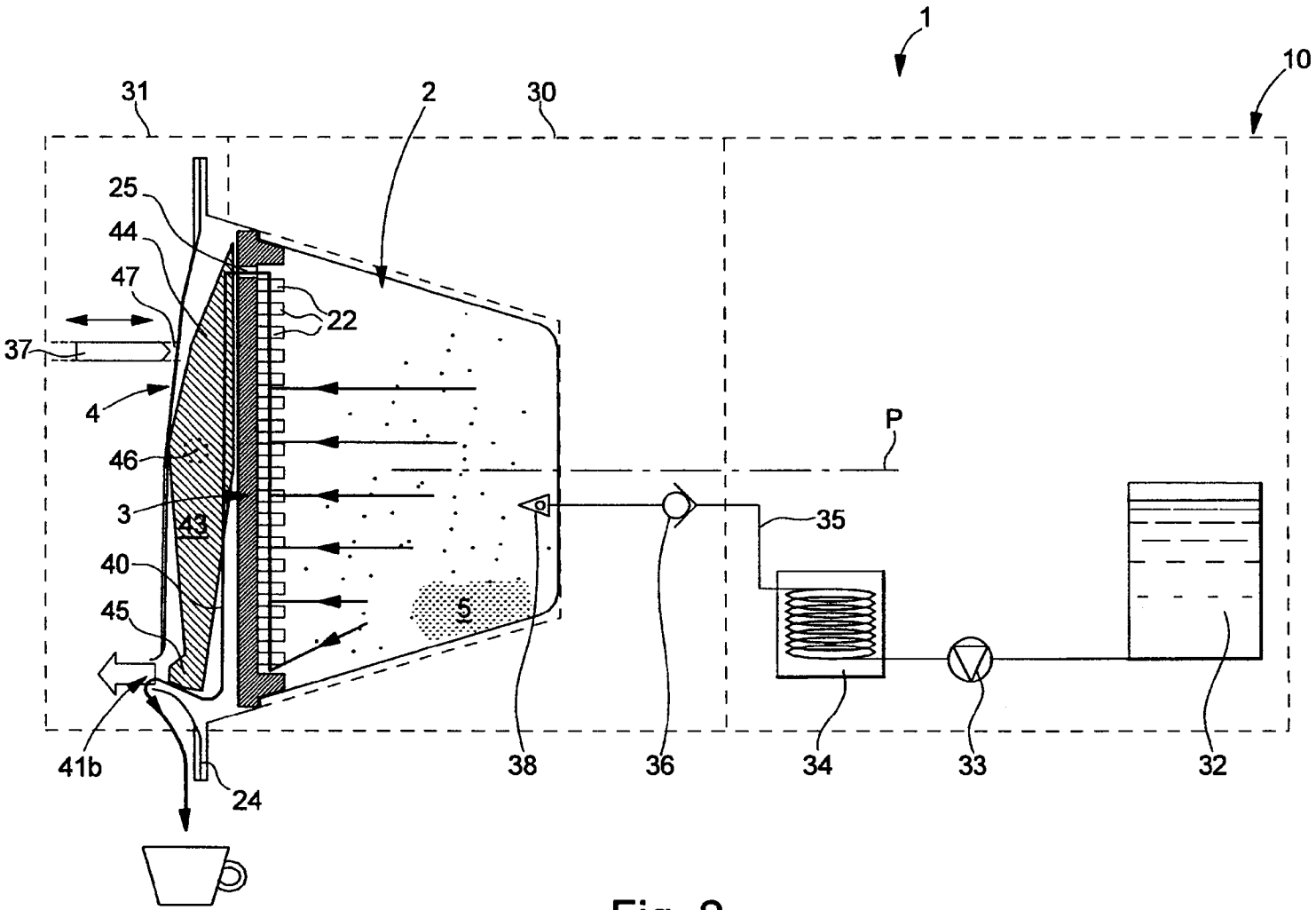
FIG. 2 is a schematic illustration of a the capsule brewing system of FIG. 1 during brewing of the capsule of the invention.

First of all, the general brewing principle of the invention will be explained in relation to FIGS. 1 and 2 and a first possible embodiment of the capsule of the invention.

DETAILED DESCRIPTION OF THE INVENTION

A capsule system 1 is provided that comprises a capsule 2 and a beverage brewing device 10. For simplicity, the beverage brewing device is only schematically depicted and may, in reality, comprise additional technical features within the normal knowledge of the person skilled in the art. The capsule comprises an enclosure 20 containing beverage ingredients such as leaf tea and the like. The enclosure is formed by a cup-shaped housing 21 that is closed by an overflow wall or plate 3. The content of the enclosure is preferably protected from gas and light. The housing may encompass different cross sections such as a circular, ellipsoid, square, rectangular or polygonal section that determine as a matter of fact the general circumference of the flat overflow wall 3. The enclosure is sized to accommodate a dose of leaf beverage ingredient of typically about between 1 to 10 grams, preferably 2 to 5 grams. The dose of leaf ingredient may depend on the final volume of beverage to produce. For an individual cup of tea, a typical dose can be of about 2 grams whereas for a tea pot, a typical dose can be of about 8 to 10 grams. As clearly apparent in FIG. 1, the capsule is positioned relative to the brewing device so that the overflow wall 3 extends substantially vertical and from substantially the bottom of the enclosure. For this, the capsule is preferably positioned in a "vertical" arrangement in the brewing device 10. The cup-shaped housing 21 can be so oriented with its large opening and its bottom oriented in a vertical position.

The overflow wall or plate 3 carries filtering means. These filtering means consist of an arrangement of roughly parallel studs 22 protruding from the side of the overflow wall facing the inside of the enclosure 20. As can be seen in the figures, the studs are relatively closely spaced and form a regular lattice. More specifically, the studs 22 should be arranged closely enough to enable the lattice to function as a filter and keep the majority of the solid particles contained in the brewed beverage from leaving the enclosure. The adequate distance between neighbouring studs will depend on the size of the food fragments that are brewed. Typically, this distance is in the range between 0.5 and 5 mm. The studs 22 are preferably made integral with the overflow wall 3. The overflow wall and the studs can be made from plastic by injection moulding or by any other appropriate technique known to the person skilled in the art.

As can further be seen in the figures, the studs 22 can be of a relatively short length. This length is usually in between 0.5 and 8 mm. As is apparent in the cross-sectional view of FIGS. 1 and 2, the distal ends of a plurality of studs 22 are located approximately in a plane that lies parallel and a short distance away from the overflow wall 3. In the following description, the expression "filtering space" will be used to refer to the space lying between the plane defined by the tips (or distal ends) of the studs and the overflow wall. This narrow filtering space is referenced "s" on the figures. The overflow wall 3 further comprises at least one overflow aperture 25. The overflow aperture is placed at least above the ¾ of the height of the enclosure. The overflow wall is maintained in place by a peripheral inner shoulder 23 of the housing 21.

The capsule is closed by a cover 4 that hermetically seals the cup-shaped housing 21. This cover is attached to the peripheral outer rim 24 of the housing. The cover can be attached to the peripheral rim by gluing or welding, or any other appropriate technique known to a person skilled in the art. Both the cover and the housing can be made of oxygen barrier materials so as to form an oxygen tight container. In this way, the enclosure 20 can be substantially free of oxygen so that the freshness of the beverage ingredients can be preserved during an extended period of time. The cover 4 can be a flexible membrane or a semi-rigid plastic part. Suitable materials include, but are not limited to, plastics, PET, aluminium foil, polymeric film, paper, and the like.

The enclosure is preferably oxygen free and may contain flushed inert gas such as N2, N2O or CO2.

In the present example, the outer side of the overflow wall 3 that faces the cover 4 forms an internal channel 40 that leads from the overflow aperture 25 to a tearable or pierceable zone 41*a* of the cover, which is intended to be easily torn or pierced by appropriate perforation means in order to create a beverage outlet. Alternatively, the tearable or pierceable zone can be replaced by a detachable zone of the cover that can be separated from the outer rim 24 of the housing.

A perforating element 43, forming part of the above mentioned perforation means, is housed in the space between the cover 4 and the overflow wall 3. The perforating element 43 can be manoeuvred from outside the capsule, and it can have the general form of a beam with two opposing ends 44, 45. A first one of these ends 44 tapers out to form a flattened zone, while the other end 45 has a pointed shape. The perforating element 43 extends along a longitudinal (vertical) space; i.e., an internal channel 40 and is designed to swing around a pivot 46 supported by the sides of the channel 40. The pointed end 45 of the beam faces the tearable, pierceable or detachable zone 41*a* of the cover 4. In order to activate the perforating element 43, pressure is applied onto the flattened end 44 from outside the capsule, across the flexible cover 4. The applied pressure causes the perforating element 43 to swing like a lever. Accordingly, while the flattened end 44 of the beam is pushed in the direction of the overflow wall 3, the pointed end 45 moves away from the overflow wall 3, thus pressing the tearable, pierceable or detachable zone of the cover outwards, with sufficient force to puncture it. In this way, a beverage outlet 41*b* is created in the cover 4. The pressure that is applied onto the flattened end 44 of the perforating element 43, in order to create the beverage outlet 41*b*, can be applied manually by the user prior to inserting the cartridge into the brewing device. However, as will be explained hereafter, the pressure is preferably applied by appropriate mechanical means.

The shape of the shell of the capsule is not very critical. For different reasons, preference is given to a truncated cone, or to ellipsoidal or hemispherical shapes. The shell can be manufactured industrially at lower cost by plastic thermoforming or aluminium deep drawing. This shape with smoother corners also favours the removal of the handling members and so ejection of the capsule.

Figure 3:
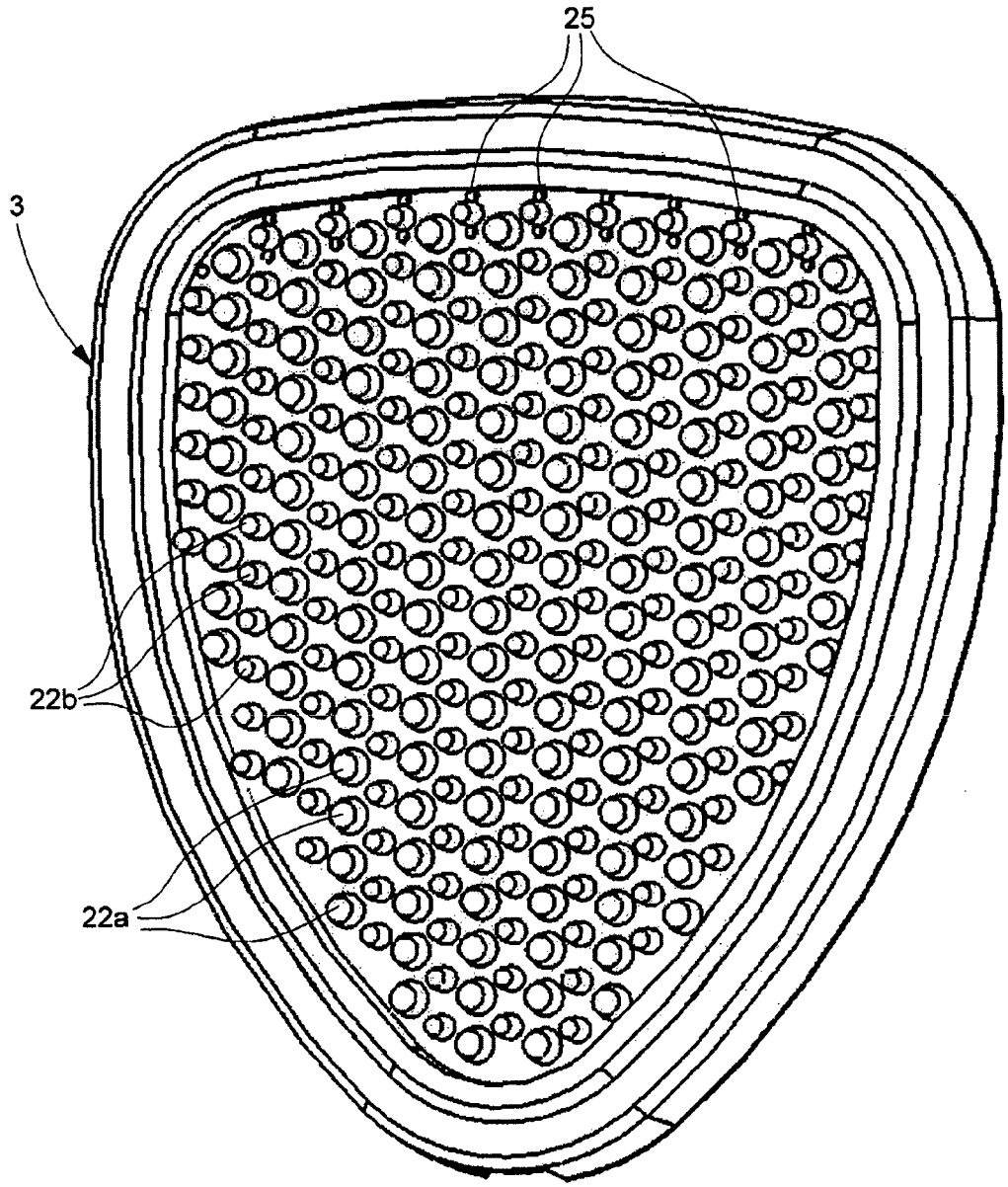
FIG. 3 is a plane view of overflow wall of the capsule of FIG. 1 showing the filtering means on the side of the overflow wall facing the enclosure.

As more particularly shown in FIG. 3, the capsule can also be shaped in general to promote and indicate to the user a particular direction for insertion into the brewing device. For instance, the capsule, more particularly the cover, can have an asymmetrical egg-shaped or shield-shaped profile with broad topside and more pointed bottom side.

Turning to the brewing device 10, it comprises capsule handling members 30, 31 that are configured to hold the capsule in the "vertical" arrangement as defined. These handling members 30, 31 can be machine jaws or any suitable mechanical enclosing means that can open and close about the capsule and can maintain it firmly in place. There is no need for providing high closing forces since the involved fluid pressure in the capsule remains relatively low and, preferably, as close as possible to the atmospheric pressure. Also, since the capsule can withstand the low brewing pressure therefore the capsule does not necessarily need to be entirely enclosed but simply held water tightly in place during brewing to prevent water leakage. This participates to a simplification of the machine and reduces machine costs.

The brewing device comprises a water supply 32, such as a water tank, a water pump 33, a heater 34 and a hot water injection line 35 that is managed through the handling member 30. The brewing device may also comprise a controller and a user interface board (not shown) to manage the beverage preparation cycles as known in the art. A backpressure valve 36 can be provided to lower the pressure at the entry side or injection member 38 (such as a needle(s) or blade(s) and a water inlet) in the capsule. Of course, the backpressure valve could be omitted and a low pressure pump could be used that delivers fluid at low pressure. Medium to high pressure pump may however be preferred because of their robustness and reliability and so used in combination with a backpressure valve.

The brewing device may further comprise a mechanical pusher 37 configured to cooperate with the perforating element 43 in order to create an outlet in the tearable, pierceable or detachable zone 41*a* of the cover 4. As shown in FIG. 1, the mechanical pusher 37 can be activated after closing of the handling members 30, 31 about the capsule. The mechanical pusher is used to manoeuvre the perforating element 43. In order to do so, the mechanical pusher 37 is forced or guided toward the flattened end 44 of the perforating element 43. Moving forwards, the mechanical pusher 37 forces a deformable zone 47 of the flexible cover 4 against the flattened end 44, thus applying pressure onto the flattened surface through the cover 4. The pressure, thus applied on the perforating element, brings about the opening of a beverage outlet 41*b*, as previously described. To avoid any cross-contamination problems, pusher 37 will preferably be arranged so as not to perforate the cover 4 in the deformable zone 47.

In the present example, the mechanical pusher 37 can be driven by a solenoid or any other equivalent drive means or even manually. However, it should be understood that according to the invention, the mechanical pusher could also be dispensed with. In this case, the perforating element 43 would be manoeuvred manually preferably before fitting the capsule 2 into the beverage brewing device 10.

In relation to FIG. 2, the method of the invention works as follows. A capsule is inserted in the brewing device and the capsule handling members are closed about the capsule to position it with the sealing wall being substantially vertically oriented. A beverage outlet 41*b* is created in the cover 4 by the mechanical pusher 37 activating the perforating element 43. On the opposite side of the capsule, the fluid injection member is introduced in the capsule's enclosure. Hot water is thus injected in the capsule at relatively low pressure, preferably, at a pressure not exceeding 0.2 bar. Hot water slowly fills the capsule and submerges the beverage ingredients in the enclosure. A portion of the beverage flows into the filtering space "s". However, most of the insoluble tea fragments contained in the beverage are held back by the studs 22. As depicted in the figures, the studs are truncated at their distal ends. An advantage of this last feature is that studs with flat ends form a more efficient barrier for the insoluble particles.

When enough hot water has flown into the capsule, the level of the brewed beverage reaches the height of the overflow aperture, allowing filtered beverage to start to flow out of the filtering space through the overflow aperture. A denser portion 5 of the beverage may tend to settle in the bottom of the enclosure. This portion can also enter the filtering space since this space extends from the bottom of the enclosure. The denser beverage can then reach the overflow aperture by flowing upwards in the filtering space "s" driven by a pressure gradient. The rest of the beverage is also filtered on entering the filtering space "s" at different vertical levels up to the upper level of the fluid in the enclosure. As is visible on the figure, the studs have rounded profiles. This shape has the advantage of offering less resistance to the passage of a fluid than would angular profiles. This promotes the upward flow of the beverage inside the filtering space. Although the rounded profile of the studs favours the upwards flow of the beverage, it does not prevent the studs from acting like a filter for the beverage flowing upwards as well as for the beverage flowing into the filtering space. In this way, the beverage going through the overflow aperture is filtered twice; once on entering the filtering space, and a second time while flowing upwards inside the filtering space.

Turning now to FIG. 3, we can see that the arrangement of studs comprises both broad studs 22*a* and narrow studs 22*b*. The diameter of the broad studs lies in between about 0.5 and 3 mm and diameter of the narrow studs lies in between about 0.5 and 2 mm. Every broad stud has a narrow stud for closest neighbour and vice versa. In FIG. 3, the pattern formed by a pair of neighbouring studs, one broad and one narrow, repeats itself regularly. One can further observe that the studs form rows across the surface of the overflow wall 3. Furthermore, studs stand closest together in rows that are oriented in the vertical direction (the spacing can be between about 0.5 and 2 mm) and conversely studs are spaced the furthest apart in the horizontal direction (the spacing can be between 0.2 and less than 2 mm). This arrangement favours the upward flow of the brewed beverage.

It should be noted that the overflow aperture is placed above the ¾ of the total height of the enclosure and is preferably placed above the ⅘ of the total height of the enclosure; thus ensuring a more complete submergence of the beverage ingredients and a slower evacuation of the beverage from the enclosure which favours a better infusion process.

It can be noted that a "direct flow" can be obtained where the brewed liquid is dispensed directly into the recipient 6 (e.g., cup, mug and the like). By "direct flow", it is meant that the outlet is arranged in respect to the brewing device so that the brewed liquid does not encounter any permanent device or part when leaving the outlet. In other words, the outlet is placed sufficiently low and laterally spaced from the capsule handling members of the beverage machine to avoid any significant contact of the liquid with these members when released.

The invention claimed is:

1. Capsule for a beverage machine comprising:

an enclosure containing food fragments;

filtering means defining at least one filtering side of the enclosure;

the capsule comprising an overflow wall that is located in a path of a brewed liquid after the filtering means and comprises at least one overflow aperture; and the filtering means being integral with the overflow wall.

2. Capsule according to claim 1, wherein the filtering means are designed to provide filtration both for a beverage flowing in a direction of the overflow wall and for a beverage flowing along the overflow wall and towards the overflow aperture.

3. Capsule according to claim 2, wherein the filtering means comprise a plurality of studs protruding from the side of the overflow wall facing the interior of the enclosure.

4. Capsule according to claim 3, wherein the studs are arranged in a series of rows.

5. Capsule according to claim 4, wherein the rows of studs extend substantially from the bottom of the enclosure to the top of the enclosure.

6. Capsule according to claim 5, wherein the rows of studs extend substantially over the whole width of the overflow wall.

7. Capsule according to claim 3, wherein a distance between neighbouring studs is less than an average size of the food fragments.

8. Capsule according to claim 3, wherein the plurality of studs have substantially the same length.

9. Capsule according to claim 3, wherein the studs have rounded cross-sections.

10. Capsule according to claim 3, wherein the studs are truncated at their distal ends.

11. Capsule according to claim 3, wherein the length of the studs is between 0.5 and 8 mm.

12. Capsule according to claim 3, wherein the rows of studs form a lattice.

13. Capsule according to claim 12, wherein neighbouring studs are spaced apart between 0.5 and 2 mm in a vertical direction.

14. Capsule according to claim 12, wherein neighbouring studs are spaced apart between 0.5 and 2 mm in a horizontal direction.

15. Capsule according to claim 12, wherein the lattice contains broad studs and narrow studs.

16. Capsule according to claim 15, wherein a diameter of the broad studs ranges between 0.5 and 3 mm and a diameter of the narrow studs ranges between 0.5 and 2 mm.

17. Capsule according to claim 1, wherein the overflow aperture is located above ¾ of the height of the enclosure.

18. Capsule according to claim 1, comprising a shell and a protective cover that is attached to the shell and forms with the shell a gas-tight container for the capsule.

* * * * *